United States Patent [19]

Bruggeman et al.

[11] Patent Number: 4,563,728

[45] Date of Patent: Jan. 7, 1986

[54] PEN LIGHT WITH ABUTTING CONTACT CLIP

[75] Inventors: Paul Bruggeman; Nova C. Hastings, both of Norwalk, Conn.

[73] Assignee: Wonder Corporation of America, Norwalk, Conn.

[21] Appl. No.: 644,773

[22] Filed: Aug. 27, 1984

[51] Int. Cl.[4] ..... F21L 9/00

[52] U.S. Cl. ..... 362/206; 362/118; 362/205; 200/60

[58] Field of Search ..... 362/118, 205, 206; 200/60, 61.58 R, 61.76; 340/707

[56] References Cited

U.S. PATENT DOCUMENTS 3,963,914 6/1976 Browning et al. ..... 362/118

4,408,263 10/1983 Sternlicht ..... 362/206 X

*Primary Examiner*—Peter A. Nelson

*Attorney, Agent, or Firm*—Darby & Darby

[57] ABSTRACT

Disclosed is a pen light having an outer casing, a lamp within the lower end of the casing, battery means within the casing in electrical contact with a first terminal of the lamp, a conductive clip for engaging the battery means toward the upper end of the casing, and a conductive member engaging a second terminal of the lamp and extending into proximity with a free end of the clip so that the free end of the clip can be pushed through a contact opening in the casing into electrical contact with the conductive member to turn on the lamp. The clip is shaped so that it abuts against the upper edge of the contact opening at a point above the free end such that the electrical circuit to the lamp can be closed when pressure is applied to the clip at the free end but cannot be closed when pressure is applied to the clip above the point of contact.

4 Claims, 4 Drawing Figures

PEN LIGHT WITH ABUTTING CONTACT CLIP

FIELD OF THE INVENTION

The present invention relates to battery powered flashlights of the type known as pen lights. More particularly, the present invention relates to the pocket retaining clip used to turn on the light.

BACKGROUND OF THE INVENTION

Pen lights are small flashlights approximately the size of a pen. They generally include a retaining clip that enables the light to be held within the user's breast pocket in the same fashion as a pen. Many pen lights are sold as disposable items (i.e., the batteries are not replaceable) and these disposable pen lights usually include an arrangement whereby the retaining clip is used as the on-off switch for the light. In one such arrangement, the clip is electrically and mechanically secured to one of the batteries at its upper end. The casing for the light includes a small opening at the lowermost extremity of the clip so that the user can push the bottom of the clip through the opening into engagement with a conductive surface within the casing to close the circuit between the batteries and light. One common construction is shown in U.S. Pat. No. 3,806,724 to Tanner et al.

With such constructions, during storage and transit, a transparent plastic sleeve is placed over the casing beneath the clip so that the clip cannot be pushed into engagement with the conductive foil within the casing. This is done to prevent inadvertent completion of the electrical circuit which might deplete the battery power unintentionally. However, many consumers are unaware of the function served by the plastic sleeves and fail to remove the sleeve before attempting to use the light. On occasion lights containing the sleeve have been returned to retail outlets by dissatisfied customers contending that the product is inoperable.

Moreover, it is relatively costly to manufacture a pen light with the clip construction shown in U.S. Pat. No. 3,806,724 because the retaining clip must be manually inserted into the casing. Furthermore, with that type of construction, in order to maintain the circuit open when the light is not being used and to reduce the likelihood of unintentional switch closure, the lower end of the clip must be separated from the conductive foil (and thus the casing) by a relatively large distance which diminishes its capacity to "clip" the pen light to the user's pocket, an annoying inconvenience to the user.

OBJECTS OF THE INVENTION

The object of the invention is to provide a pen light having a pocket retaining clip which is effective both as an electrical switch for supplying power to the lamp of the pen light, and a pocket retaining clip.

SUMMARY OF THE INVENTION

The present invention comprises a pen light having an outer casing, a lamp within the lower end of the casing, battery means within the casing in electrical contact with a first terminal of the lamp, a conductive clip for engaging the battery means toward the upper end of the casing, and a conductive member engaging a second terminal of the lamp and extending into proximity with a free end of the clip so that the free end of the clip can be pushed through a contact opening in the casing into electrical contact with the conductive member to turn on the lamp. The clip is shaped so that it abuts against the upper edge of the contact opening at a point above the free end such that the electrical circuit to the lamp can be closed when pressure is applied to the clip at the free end but cannot be closed when pressure is applied to the clip above the point of contact.

DETAILED DESCRIPTION OF THE INVENTION

Figure 1:
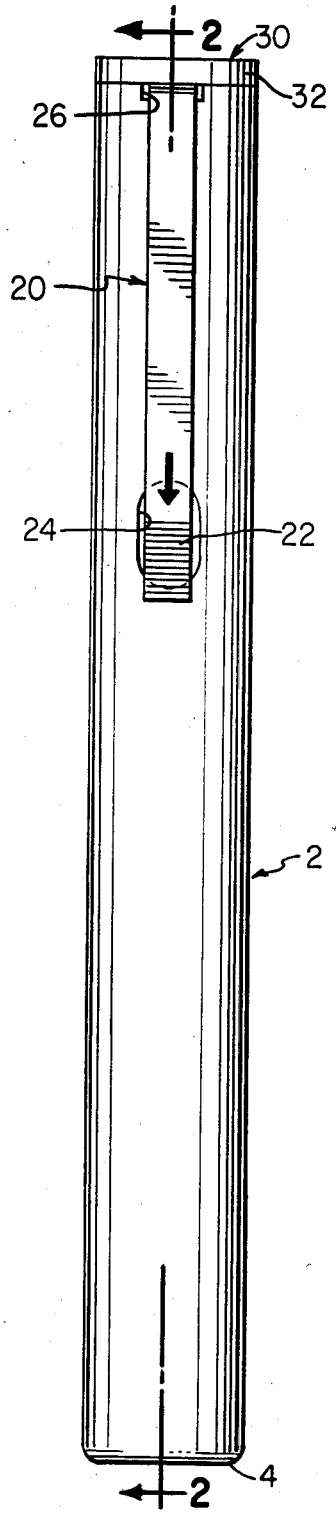
FIG. 1 is a front view of the pen light showing the retaining clip switch.
Figure 2:
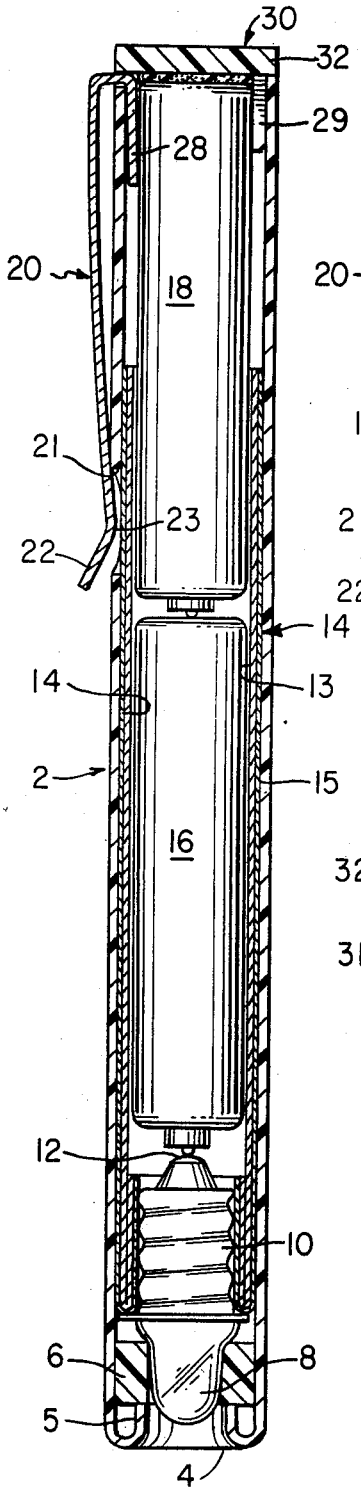
FIG. 2 is a partial sectional view along the lines 2—2 of FIG. 1 showing the switch in the "off" position.

A pen light, according to the present invention, includes an open-topped cylindrical casing 2 in the form of a hollow cylinder of dielectric material having a lower inwardly rolled end 4 creating a flange 5 on which rests a resilient bushing 6. Bushing 6 secures electric lamp 8 in the lower end of cylindrical casing 2. Electric lamp 8 has conventional electrical contacts 10 and 12, situated along the circumference and center of the lower end of lamp 8, respectively.

A conductive tube 14, constructed of an inner dielectric layer 13 (e.g., cardboard), and an outer conductive foil layer 15, is positioned within cylindrical casing 2. The bottom of conductive tube 14 is folded inwardly so that outer conductive foil layer 15 is in firm contact with circumferential electrical contact 10 of lamp 8.

Cylindrical, uninsulated batteries 16 and 18 having an outside diameter approximately equal to the inside diameter of conductive tube 14 are placed within conductive tube 14 in series so that the "positive" terminal of battery 16 is in electrical contact with contact 12 of electric lamp 8.

The upper end of cylindrical housing 2 contains a slot 26 along its circumference. An electrically conductive retaining clip switch 20, having a hook end 28 and a free end 22 is fitted onto cylindrical casing 2 through slot 26. The hook end 28 retains the switch on the casing and provides electrical contact with the "negative" terminal of battery 18.

Contact opening 24 is provided in cylindrical casing 2, exposing the conductive foil layer 15 of conductive tube 14. In accordance with the invention, the clip 20 is shaped so that when upper hook end 28 is secured in position, the clip abuts against the upper edge 21 of contact opening 24 with the free end 22 prevented from contacting outer conductive foil layer 15.

Cap 30 having a side wall 31 is inserted into the upper end of cylindrical casing 2 in order to secure the components therein. Cap 30 is pressure fit into the upper end of cylindrical casing 2 and serves to retain clip 20 and batteries 16 and 18 in position. An outer upper flange 32 is provided so that the cap may be removed to replace the batteries, if desired. Alternatively, the cap may be configured such that it is not easily removable, if a solely disposable pen light arrangement is desired. A slot 29 is provided in sidewall 31 in order to allow the cap to be fit over the hook end 28 of retaining clip switch 20.

Figure 3:
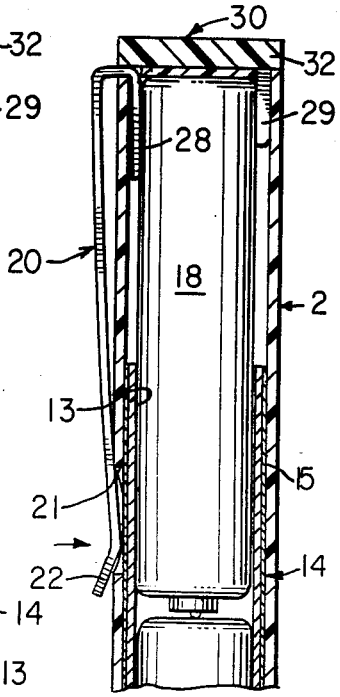
FIG. 3 is a view similar to that of FIG. 2, but showing the clip switch in the "on" position.
Figure 4:
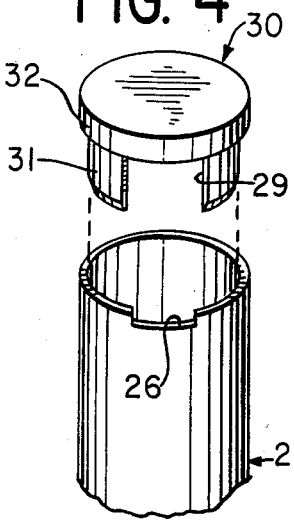
FIG. 4 is an elevated perspective view of the upper end of the pen light where the clip switch is retained by a slotted plug.

In order to activate the switch to the "on" position completing the electric circuit and lighting electric lamp 8, an inward force is exerted at the free end 22 of retaining switch clip 20. A force can be exerted by the user's thumb or fingertip anywhere along switch 20 below the contact point with upper edge 21 of contact opening 24. The force exerted will cause the inner fulcrum point 23 to contact outer conductive foil layer 15. Because the hook end 28 of switch 20 is in contact with the negative terminal of battery 18, the electrical connection between inner contact point 23 and outer conductive foil layer 15 will electrically connect the negative terminal of battery 18 with the circumferential electrical contact 10 of electrical lamp 8, thereby completing the electric circuit supplying electrical energy to lamp 8. FIG. 3 shows switch 20 in the closed position, with a force exerted at the contact point 23. Removal of the force on the lower fulcrum end 22, will cause switch 20 to return to its original position opening the circuit, and turning off the light.

The arrangement of the present invention of the lower end of retaining clip 20 eliminates the disadvantages of prior retaining clip switches in that minimal travel is required in order to complete the circuit. In addition, when the switch is in the open (off) position, sufficient inward force is present for the switch to act as a suitable retaining clip for e.g., a shirt pocket. Further, activation of the switch to the on position requires a localized force be applied to retaining switch 20 below the fulcrum point 21 in order to complete the circuit. If the force is applied above fulcrum point 21, the circuit will not be completed and in fact, contact point 23 will be positioned further away from conductive foil layer 15. This arrangement makes it very unlikely that the switch will be accidentally activated.

If a removable cap arrangement is provided, the hook feature of retaining clip 20 permits the pen light of the present invention to be reusable because it can be taken apart and new batteries or a replacement lamp supplied. Previous pen lights utilizing a radial clamp to secure the clip switch to the batteries were disposable and incapable of being taken apart and supplied with fresh batteries, because the casing would be destroyed in the process.

What is claimed is:

1. A pen light comprising an outer casing, a lamp within the lower end of the casing, battery means within the casing in electrical contact with a first terminal of the lamp, a conductive clip for engaging the battery means toward the upper end of the casing, and a conductive member within the casing engaging a second terminal of the lamp and extending into proximity with a free end of the clip so that the free end of the clip can be pushed through a contact opening in the casing into electrical contact with said conductive member to turn on the lamp, wherein said clip is shaped so that it abuts against the upper edge of said contact opening at a point above said free end such that the electrical circuit to the lamp can be closed when pressure is applied to the clip at the free end but cannot be closed when pressure is applied to the clip above said point.

2. The pen light of claim 1 wherein said conductive clip has an upper hooked end for engaging the battery means toward the upper end of the casing.

3. The pen light of claim 1 further comprising removable cap means at the upper end of the casing.

4. The pen light of claim 2 further comprising removable cap means at the upper end of the casing.

* * * * *